US005493968A

United States Patent [19]

Ishikawa

[11] Patent Number: 5,493,968

[45] Date of Patent: Feb. 27, 1996

[54] IMAGE FORMING APPARATUS

[75] Inventor: Makoto Ishikawa, Tokyo, Japan

[73] Assignee: Riso Kagaku Corporation, Tokyo, Japan

[21] Appl. No.: 272,214

[22] Filed: Jul. 8, 1994

[30] Foreign Application Priority Data

Jul. 14, 1993 [JP] Japan ..... 5-174368

[51] Int. Cl.[6] ..... B41L 13/00; B41J 13/26

[52] U.S. Cl. ..... 101/118; 400/624; 271/10.11

[58] Field of Search ..... 101/118, 117, 101/116; 400/624, 625; 271/9, 10, 109, 116, 119, 264, 242, 114

[56] References Cited

U.S. PATENT DOCUMENTS

| | | | |
|---|---|---|---|
| 1,237,820 | 8/1917 | Rogers | 101/118 |
| 4,391,542 | 7/1983 | Baitz | 400/624 X |
| 4,586,813 | 5/1986 | Ide | 355/50 |
| 4,790,524 | 12/1988 | Murakami et al. | 271/10 |
| 5,067,835 | 11/1991 | Yamamoto et al. | 400/624 X |
| 5,141,346 | 8/1992 | Nakagawa | 480/624 X |

FOREIGN PATENT DOCUMENTS

| | | |
|---|---|---|
| 0110204 | 6/1984 | European Pat. Off. . |
| 2266517 | 11/1993 | United Kingdom . |

OTHER PUBLICATIONS

Patent Abstracts of Japan, vol. 13, No. 247(M–835), Jun. 8, 1989, Mita Ind., Co., Ltd.

Patent Abstracts of Japan, vol. 17, No. 541(M–1488), Jun. 15, 1993, Mita Ind., Co., Ltd.

Patent Abstracts of Japan, vol. 8, No. 271(P–320), Aug. 11, 1984, Canon KK.

Patent Abstracts of Japan, vol. 15, No. 452(M–1180), Aug. 21, 1991, Tokyo Koku Keiki KK.

Patent Abstracts of Japan, vol. 11, No. 247(M–615), Mar. 11, 1987, Riso Kagaku Corp.

Patent Abstracts of Japan, vol. 15, No. 452(M–1180), Aug. 23, 1991, Ricoh Co., Ltd.

*Primary Examiner*—Christopher A. Bennett

*Attorney, Agent, or Firm*—Kanesaka & Takeuchi

[57] ABSTRACT

An image forming apparatus forms desired images continuously onto print sheets. The apparatus includes a printing part, a primary sheet feed mechanism for extracting one by one the print sheets stacked on a sheet feed table, and a secondary sheet feed mechanism for taking each print sheet extracted by the primary sheet feed mechanism and for feeding the print sheet toward the printing part at a rate corresponding to the printing speed of the printing part. The secondary sheet feed mechanism further comprises a timing roller and a guide roller in contact with the print sheet for feeding thereof, an electromagnetic clutch for intermittently activating one of the timing roller and the guide roller, and a controller for receiving a detection signal showing a rotating status of the printing part and for supplying the electromagnetic clutch accordingly with an output signal in synchronism with the rotating status.

4 Claims, 9 Drawing Sheets

IMAGE FORMING APPARATUS

BACKGROUND OF THE INVENTION

The present invention relates to an image forming apparatus for forming images on sheets of printing paper and, more particularly, an image forming apparatus capable of printing images efficiently on a large number of print sheets.

FIG. 10 is a side view of a conventional image forming apparatus that functions as a mimeograph machine. A thermally prepared original sheet is stuck around the outer circumference of a drum 30 constituting a part of a printing section. Print sheets P are fed continuously between the drum 30 and a press roller 30*a*, whereby the image of the original is mimeographed onto the print sheets.

The print sheets P are stacked on a sheet feed table 31. The sheets are picked up one by one, from a top sheet to bottom, by a scraper roller 32 and a pickup roller 33. The two rollers constitute a primary sheet feed mechanism 37. The picked up sheets are fed toward the drum 30.

Between the drum 30 and the pickup roller 33 is provided a timing roller 40 which, driven intermittently, constitutes part of a secondary sheet feed mechanism 38. The timing roller 40 in operation transports each print sheet P for printing by the drum 30 at an appropriate timing synchronous with the drum revolutions.

As outlined, the typical mimeograph machine comprises the primary and secondary sheet feed mechanisms 37 and 38. The two-stage sheet feed arrangement is required for the mimeograph machine to operate at a higher speed than other printers such as copiers. The primary sheet feed mechanism 37 extracts the print sheets P slowly and one by one from the sheet feed table 31; the mechanism makes sure that it does not pick up inadvertently two or more sheets at a time. The secondary sheet feed mechanism 38 feeds the print sheets P to the drum 30 rotating at a high speed, the rate of print sheet feed being synchronized with the drum revolutions. The mimeograph machine may be switched stepwise from low to high printing speeds.

A belt 46 is held taut over the drum 30, a plurality of idlers 35, and the shaft 45*a* of a motor 45. The motor 45 rotates the drum 30. The driving force of the motor 45 is also used to activate the timing roller 40 intermittently in an intermittent driving mechanism 50.

The intermittent driving mechanism is structured as follows: a guide roller cam 51 and a timing roll cam 52 are attached fixedly to the shaft 45*a* of the motor 45. One end 53*a* of a substantially fan-shaped gear 53 is in contact with the guide roller cam 51, and one end 54*a* of a timing lever 54 is in contact with the timing roll cam 52.

The fan-shaped gear 53 swings around a shaft 53*c* when the guide roller cam 51 is rotated. The other end 53*b* of the gear 53 is engaged with a guide roller 55. While in swing motion, the gear 53 has its end 53*b* rotate the guide roller 55 clockwise. A rotating timing roll cam 52 causes the other end 54*b* of the timing lever 54 to swing intermittently, thereby actuating the timing roller 40 toward the guide roller 55.

As the guide roller 55 rotates in the forward direction, the timing roller 40 is urged toward the guide roller 55. The motion feeds each print sheet P toward the drum 30 at an appropriate timing.

One disadvantage of the conventional mimeograph machine is the complexity described above of the intermittent driving mechanism 50 that drives intermittently the timing roller 40 making up a part of the secondary sheet feed mechanism 38. Another disadvantage is that the machine is subject to inherent constraint on the speed of its printing. That is, the intermittent driving mechanism 50 is structured fixedly in such a manner that one print sheet P is fed in synchronism with a single revolution of the drum 30. Thus the only way to increase the printing speed is to raise the revolutions of the drum 30, i.e., the rotating speed of the motor 45. The procedure involved has its obvious limitations.

Because one revolution of the drum 30 results in the printing of only a single print sheet P, only one original mimeograph sheet of a predetermined size is allowed to be attached over the drum 30. A thermally prepared original plate, which is diverse in size, may be substantially small compared with the mimeograph sheet but must be integrated with the latter for printing of one print sheet P alone per revolution of the drum 30. In other words, even if the size of an original plate is so small that two or more plates might be accommodated in one original mimeograph sheet, the conventional mimeograph machine does not permit that sort of use.

If, say, two plates were to be formed in one original mimeograph sheet and if two print sheets P were to be fed in synchronism with each revolution of the drum 30, a far larger number of print sheets would be printed and the printing speed would be boosted significantly. As it is, the conventional machine still uses the intermittent driving mechanism 50 with its fixed operation for feeding print sheets P; the machine is thus limited to the way it works as described above.

With the conventional mimeograph machine, print sheets P may be adjusted in vertical image forming position by moving the two idlers 35*a* (FIG. 10) up and down. Moving the idlers 35*a* in this manner adjusts the synchronism between the rotation of the drum 30 and the intermittent operation of the intermittent driving mechanism 50. This in turn adjusts the feed operation of print sheets P relative to the original mimeograph sheet so that the image forming position on the print sheet surface will be regulated vertically. Adjustment of the vertical image forming position involves the chores of mechanically relocating the idlers 35*a*, which makes the accurate fine-tuning of the image position all the more difficult.

SUMMARY OF THE INVENTION

It is therefore an object of the present invention to overcome the above and other disadvantages and deficiencies of the prior art and to provide an efficient, simply structured image forming apparatus capable of feeding print sheets toward the drum at desired rates for high speed printing.

In carrying out the invention and according to one aspect thereof, there is provided an image forming apparatus for forming desired images continuously onto print sheets, the apparatus comprising a printing part, a primary sheet feed mechanism for extracting one by one the print sheets stacked on a sheet feed table, and a secondary sheet feed mechanism for taking each print sheet extracted by the primary sheet feed mechanism and for feeding the print sheet toward the printing part at a rate corresponding to the printing speed of the printing part. The secondary sheet feed mechanism further comprises a timing roller and a guide roller in contact with the print sheet for feeding thereof, an electromagnetic clutch for intermittently activating any of the timing roller and the guide roller, and control means for receiving a detection signal showing a rotating status of the printing part and for supplying the electromagnetic clutch accordingly with an output signal in synchronism with the rotating status.

In a preferred structure according to the invention, the printing part is variably switchable to different printing speeds in accordance with motor revolutions, and the control means includes delay means for outputting an output signal generated through delaying the detection signal by a delay period corresponding to a currently selected printing speed. The output signal so delayed causes the operation timing of the electromagnetic clutch to vary in keeping with the currently selected printing speed of the printing part.

In another preferred structure according to the invention, the control means includes vertical position setting means for having a vertical position of print sheets established therein beforehand and for outputting a vertical position signal corresponding to the established vertical position, and the delay means modifies the operation timing of the electromagnetic clutch by varying the delay period in accordance with the vertical position signal. With this structure, the vertical position of the image to be printed is changed as desired relative to the print sheet surface.

In a further preferred structure according to the invention, the control means further comprises: N-sheet feed setting means for having a variable number N of print sheets established therein for printing during each revolution of the printing part, and for outputting a selection signal corresponding to the established number N of the print sheets; and pulse generating means for receiving the selection signal from the N-sheet feed setting means and for outputting a plurality of pulse signals representing N print sheets derived from the selection signal. With this structure, the electromagnetic clutch is activated N times during one operation of the printing part to which the N print sheets are fed.

In any of the inventive structures outlined above, the secondary sheet feed mechanism receives the print sheets fed one by one from the primary sheet feed mechanism, and forwards the received sheets toward the printing part whose printing speed is set variably.

The secondary sheet feed mechanism includes the timing roller and guide roller coming into contact with each print sheet and rotating in accordance with the motor revolutions. These rollers in operation combine to supply the printing part with the print sheets.

The timing roller and guide roller are activated intermittently by the electromagnetic clutch. The timing of the roller rotation is controlled by the control means.

Specifically, the control means receives the rotating status of the printing part as the detection signal, and supplies the electromagnetic switch with the output signal in synchronism with the rotating status. In this manner, the print sheets are fed consecutively to the printing part for printing thereby.

These and other objects, features and advantages of the invention will become more apparent upon a reading of the following description and appended drawings.

DESCRIPTION OF THE PREFERRED EMBODIMENTS

Figure 1:
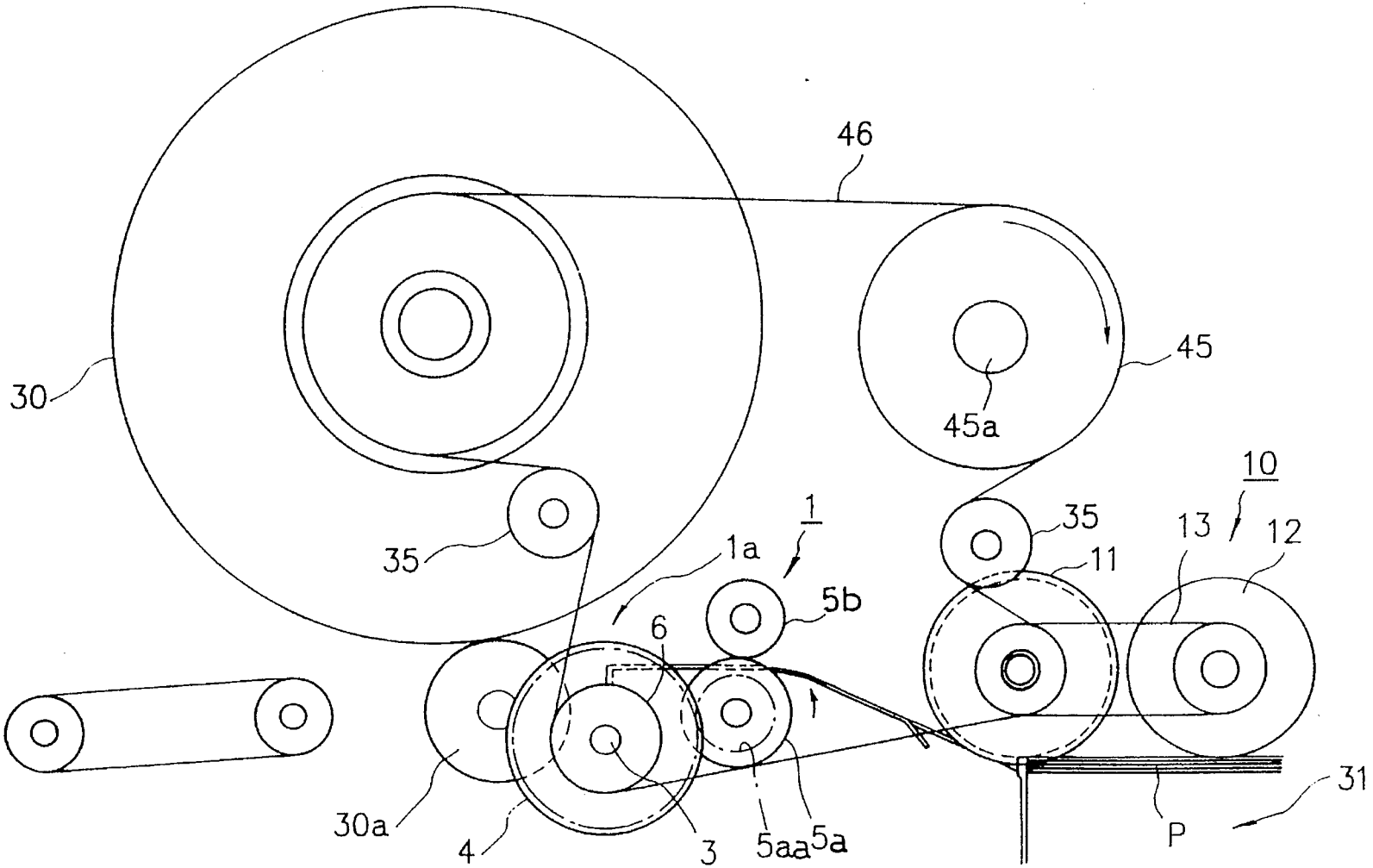
FIG. 1 is a side view of an image forming apparatus embodying the invention.

FIG. 1 is a side view of an image forming apparatus embodying the invention. As in the conventional image forming apparatus described above, an apparatus in this embodiment functions as a mimeograph machine. It should be noted that the parts that are identical to those already described in connection with the conventional apparatus are designated by the same reference characters, with any repetitive description thereof omitted.

Figure 2:
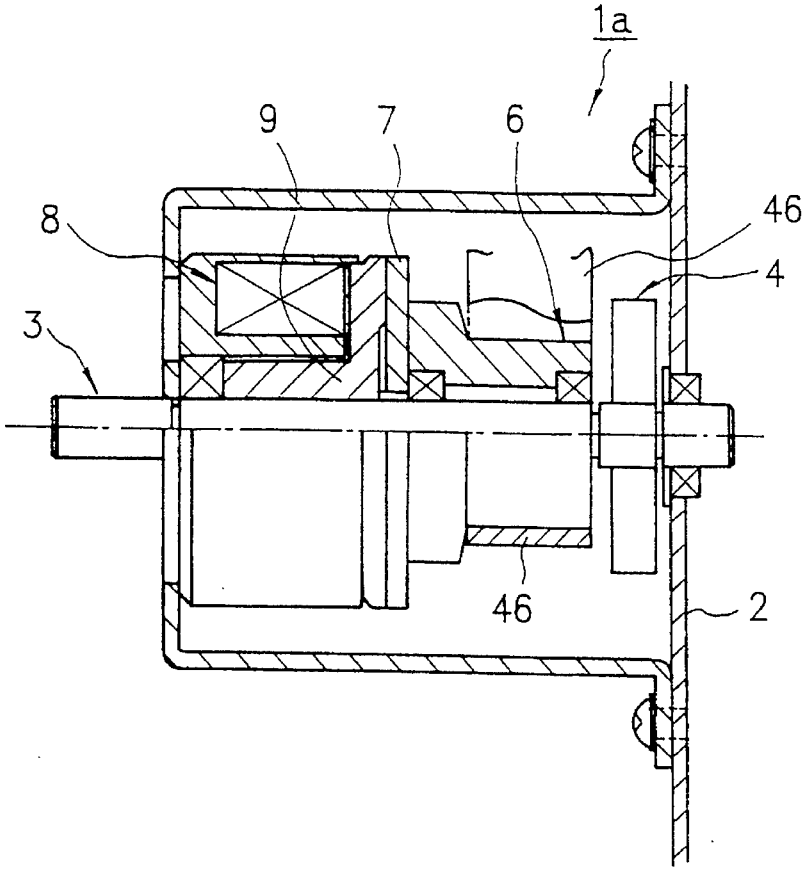
FIG. 2 is a partially cutaway view of an electromagnetic clutch in a secondary sheet feed mechanism of the embodiment.

A secondary sheet feed mechanism 1 of the embodiment has an electromagnetic clutch 1*a* partially in contact with the belt 46. As illustrated in FIG. 2, the electromagnetic clutch 1*a* has a clutch shaft 3 supported rotatably by a side plate 2. A gear 4 of a large diameter fixed to one end of the clutch shaft 3 is engaged with a gear 5*aa* of a small diameter of a timing roller 5*a*. In the middle of the clutch shaft 3 is a pulley 6 supported in a rotatably floating manner. The belt 46 is held taut around the outer circumference of the pulley 6. An armature 7 is attached fixedly to one end of the pulley 6.

The other end of the clutch shaft 3 is equipped with an electromagnetic coil 8. A rotor 9 is fixed to that part of the clutch shaft 3 which carries the electromagnetic coil 8. When the electromagnetic coil 8 is powered, the rotor 9 attracts the armature 7 of the pulley 6 in order to transmit the torque of the belt 46 to the clutch shaft 3. That is, only when the electromagnetic coil 8 is powered, the timing roller 5*a* rotates to feed frictionally toward the drum 30 a print sheet P in contact with a guide roller 5*b* located opposite to the timing roller 5*a*. The gears 4 and 5*aa* differ in diameter, constituting a gear ratio such that the timing roller 5*a* rotates at a high speed.

When the electromagnetic coil 8 is not powered, only the belt 46 and pulley 6 rotate. The components ranging from the clutch shaft 3 to the timing roller 5*a* are held stationary by a brake attached to the timing roller 5*a*.

A similar electromagnetic clutch is also provided on a pickup roller 11 of a primary sheet feed mechanism 10. When this electromagnetic clutch is powered, the torque of the belt 46 drives the pickup roller 11 to extract a print sheet P from the sheet feed table 31. In conjunction with the pickup roller 11, a scraper roller 12 driven with a belt 13 helps to feed the print sheets from the sheet feed table 31. To prevent inadvertent feed of two or more sheets at a time, the primary sheet feed mechanism 10 does not utilize a specific gear ratio which characterizes the secondary sheet feed mechanism 1. Instead, the primary sheet feed mechanism 10 feeds print sheets P at a lower speed than the secondary sheet feed mechanism 1.

Figure 3:
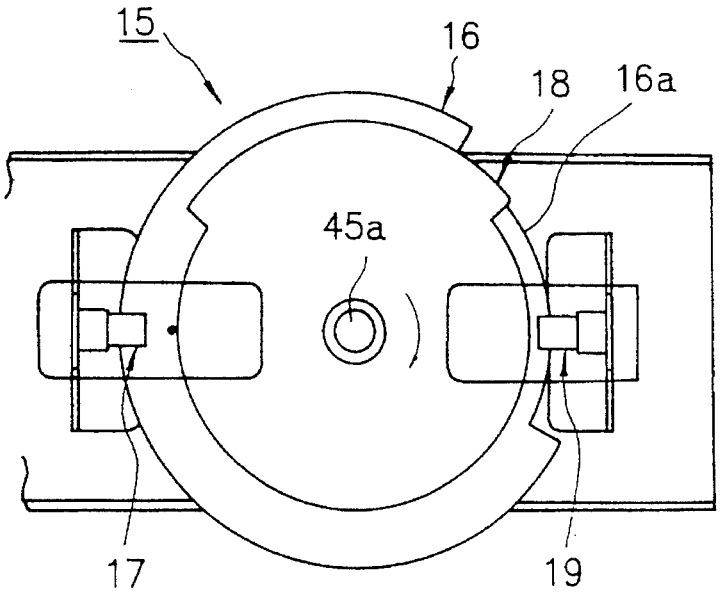
FIG. 3 is a schematic view of rotation detecting means of the embodiment.

FIG. 3 schematically shows rotation detecting means 15 furnished on the motor 45. FIG. 3 in fact depicts what is seen from the back of the view of FIG. 1. The rotation detecting means 15 determines the timing of power application to the electromagnetic coil 8 of the secondary sheet feed mechanism 1. A secondary detection disc 16 having a groove portion 16*a* of a given length is fixedly attached to the shaft 45*a* of the motor 45. On the outer circumference of the secondary detection disc 16 is a secondary photo interrupter 17. When the motor 45 rotates, the secondary photo interrupter 17 supplies control means 20, to be described later, with a detection signal S1 during a timer set time starting from a set point SP1 (FIG. 5) representing an encounter with the groove portion 16*a*. The secondary photo interrupter 17 may be arranged alternatively to output the detection signal S1 while light is passing therethrough.

Likewise, the rotation detecting means 15 is provided with a primary detection disc 18 and a primary photo interrupter 19. The primary detection disc 18 has also a groove portion of a given length used to determine the timing of power application to the electromagnetic coil of the primary sheet feed mechanism 10. In a setup similar to that described above, the primary photo interrupter 19 supplies the control means 20 with a signal similar to the detection signal discussed.

Figure 4:
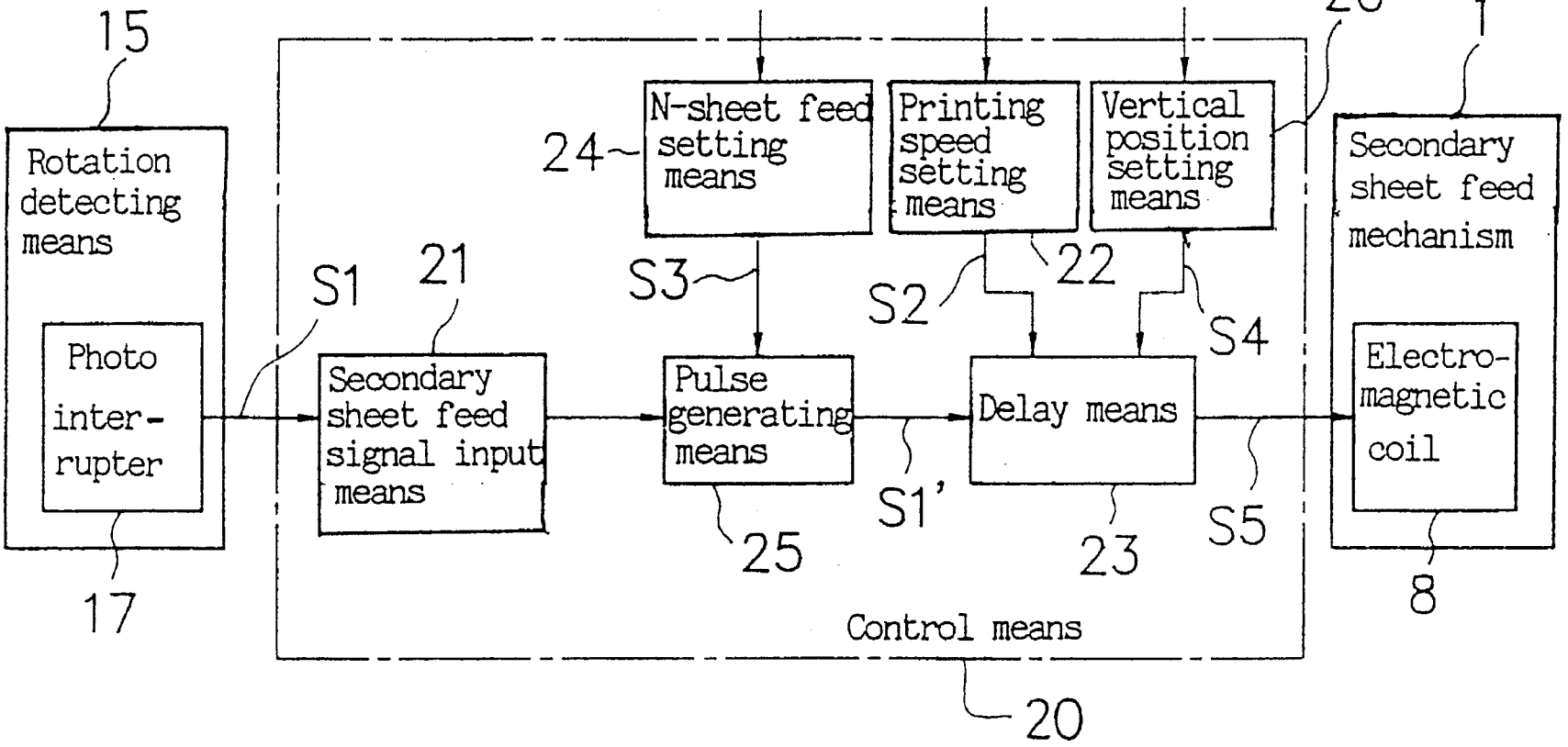
FIG. 4 is a block diagram of control means for the secondary sheet feed mechanism.

FIG. 4 is a block diagram of the control means 20 that controls the secondary sheet feed mechanism 1. The other components involved with the print operation are controlled by separately provided control means. Secondary sheet feed signal input means 21 of the control means 20 is fed with the detection signal S1 for a certain period of time from the secondary photo interrupter 17 of the rotation detecting means 15.

A plurality of printing speeds that may be switched stepwise (corresponding to the revolutions of the motor 45) are set beforehand in printing speed setting means 22. When a given printing speed is selected from the outside, a stepwise speed signal S2 corresponding to the selected speed is output to delay means 23.

The delay means 23 supplies the electromagnetic coil 8 of the secondary sheet feed mechanism 1 with an output signal S5. This is a signal obtained by delaying the detection signal S1 by a predetermined delay time corresponding to the stepwise speed signal S2.

Vertical position setting means 26 is provided to adjust from the outside the image forming position in the vertical direction (i.e., in the print sheet P feed direction) on the surface of print sheets P. Illustratively, the image forming position may be shifted vertically in a range of −20 mm to 20 mm with respect to a reference point on the sheet surface. The vertical position setting means 26 supplies the delay means 23 with a vertical position signal S4 representing the amount of the vertical position adjustment effected.

When N-sheet feed mode is selected from the outside, N-sheet feed setting means 24 supplies pulse generating means 25 with a selection signal S3 designating N-sheet feed (i.e., from sheet 1 to sheet N). Upon receipt of the detection signal S1 of a given duration from the secondary sheet feed signal input means 21 in N-sheet feed mode, the pulse generating means 25 outputs to the delay means 23 a signal S1' comprising N pulses corresponding to the N sheets.

The embodiment of the above constitution carries out a sheet feed operation as follows: the motor 45 is first started to rotate at a predetermined printing speed. The torque of the motor 45 is transmitted via the belt 46 to the drum 30 over which an original mimeograph sheet is stuck. The embodiment is now ready to print sheets.

The primary photo interrupter 19 of the rotation detecting means 15 then activates the primary sheet feed mechanism 10 intermittently at a predetermined timing. Operating intermittently, the primary sheet feed mechanism 10 extracts print sheets P one at a time from the sheet feed table 31, at a low speed proportionate to the revolutions of the motor 45. Each extracted sheet is forwarded to the secondary sheet feed mechanism 1.

The secondary sheet feed mechanism 1 operates intermittently at an appropriate timing corresponding to the detection signal S1 from the secondary photo interrupter 17 of the rotation detecting means 15. In doing so, the secondary sheet feed mechanism 1 takes a print sheet P at a speed higher than that proportionate to the revolutions of the motor 45, the higher speed being effected by the specific gear ratio of the mechanism 1. The sheet so taken is fed toward the drum 30.

More specifically, the secondary sheet feed mechanism 1 works as follows: the timing of sheet feed operation is started when the detection signal S1 from the secondary photo interrupter 17 is detected. The timing roller 5*a* of the secondary sheet feed mechanism 1 starts rotating when the leading edge of a print sheet P reaches the roller 5*a*, at the latest. The sheet feed timing may be set as desired illustratively by varying the relative angle between the primary and secondary detection discs 18 and 16.

Figure 5:
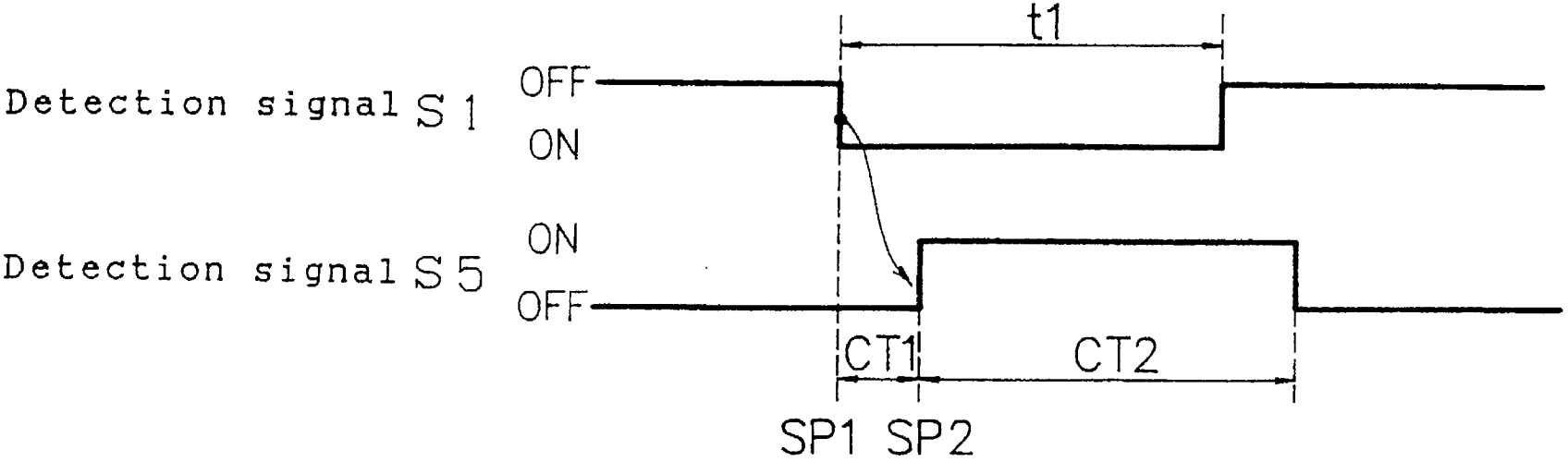
FIG. 5 is a timing chart of control signals used by the control means.

As shown in the timing chart of FIG. 5, the timing roller 5*a* is started to rotate at a set point SP1 at which is detected the detection signal S1 of an appropriate duration t1 corresponding to a variably selected printing speed. Upon elapse of a delay time CT1 occurs the output signal S5 that is output to the electromagnetic coil 8 for a period of CT2 (t1=CT2). The output period CT2 of the output signal S5, determined in this example by the delay means 23, may alternatively be established by counting means for counting pulses of an encoder in synchronism with the revolutions of the motor 45.

The delay time CT1 is determined beforehand by taking into consideration the mechanical transmission characteristics of the components ranging from the electromagnetic coil 8 to the timing roller 5*a* constituting the secondary sheet feed mechanism 1. What needs to be considered in particular is the tendency of the armature 7 and rotor 9 to become increasingly slippery as the speed increases.

When a higher printing speed is set, the delay means 23 shortens correspondingly the delay time to move the output timing SP2 forward and closer to the set point SP1. Thus the print sheets P are first fed unfailingly, one by one at a low speed, by the primary sheet feed mechanism 10. The print sheets are then fed at a speed high enough to cope with the revolutions of the drum 30 by the secondary sheet feed mechanism 1 set to a specific gear ratio.

The output period CT2 during which the output signal S5 is output is determined by the above-mentioned delay means 23 as a period substantially equal to the period t1 of the detection signal S1. Alternatively, a shorter output period CT2 may be set as the printing speed increases. The alternative also involves taking into account the mechanical transmission characteristics of the secondary sheet feed mechanism 1.

When the vertical position setting means 26 varies and then sets the vertical image forming position, the means 26 supplies the delay means 23 with a vertical position signal S4 representing the varied amount of relocation. The delay time CT1 varied in keeping with the printing speed is further modified by the vertical position signal S4. After modification, the delay time CT1 is followed by the output signal S5 that is sent out.

Figure 6:
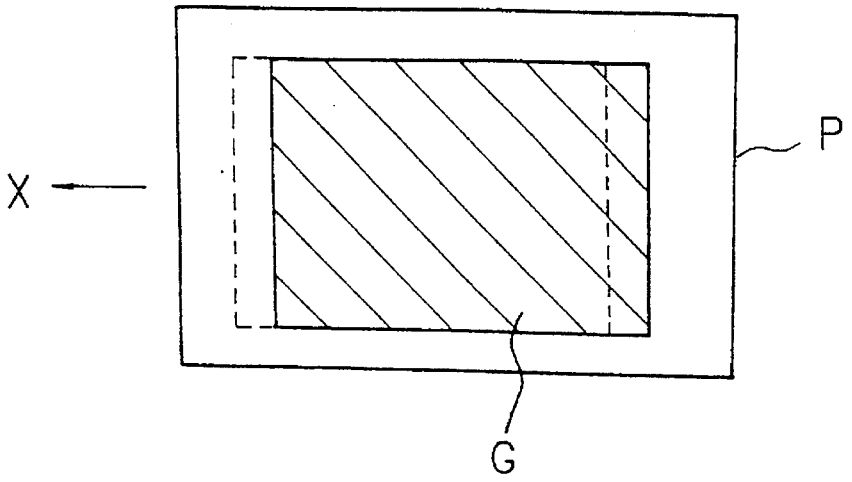
FIG. 6 is a view showing how the vertical image forming position is adjusted relative to the print sheet surface.

Suppose that as shown in FIG. 6, the vertical position of an image G is to be moved up (i.e., to the position indicated by broken line) in the X direction in which the print sheet P is fed. In that case, the delay means 23 modifies the vertical position signal S4 by supplementing the delay time CT with a time period representing the amount of the relocation effected.

The signal so modified shifts the timing of secondary feed operation of the print sheet P relative to the image in the original mimeograph sheet stuck over the drum 30. This in turn causes the image formed on each print sheet P to be shifted as desired in the X direction.

As described, the embodiment of the invention utilizes a simplified structure incorporating the electromagnetic clutch la in the secondary sheet feed mechanism for the secondary sheet feed operation. When the printing speed is varied, the time setting on the electromagnetic clutch 1*a* only be changed so as to adjust the secondary feed timing with accuracy. For vertical image forming position adjustment, the delay time of the electromagnetic clutch 1*a* need only be varied, and no special measures for the adjustment are required.

Figure 7:
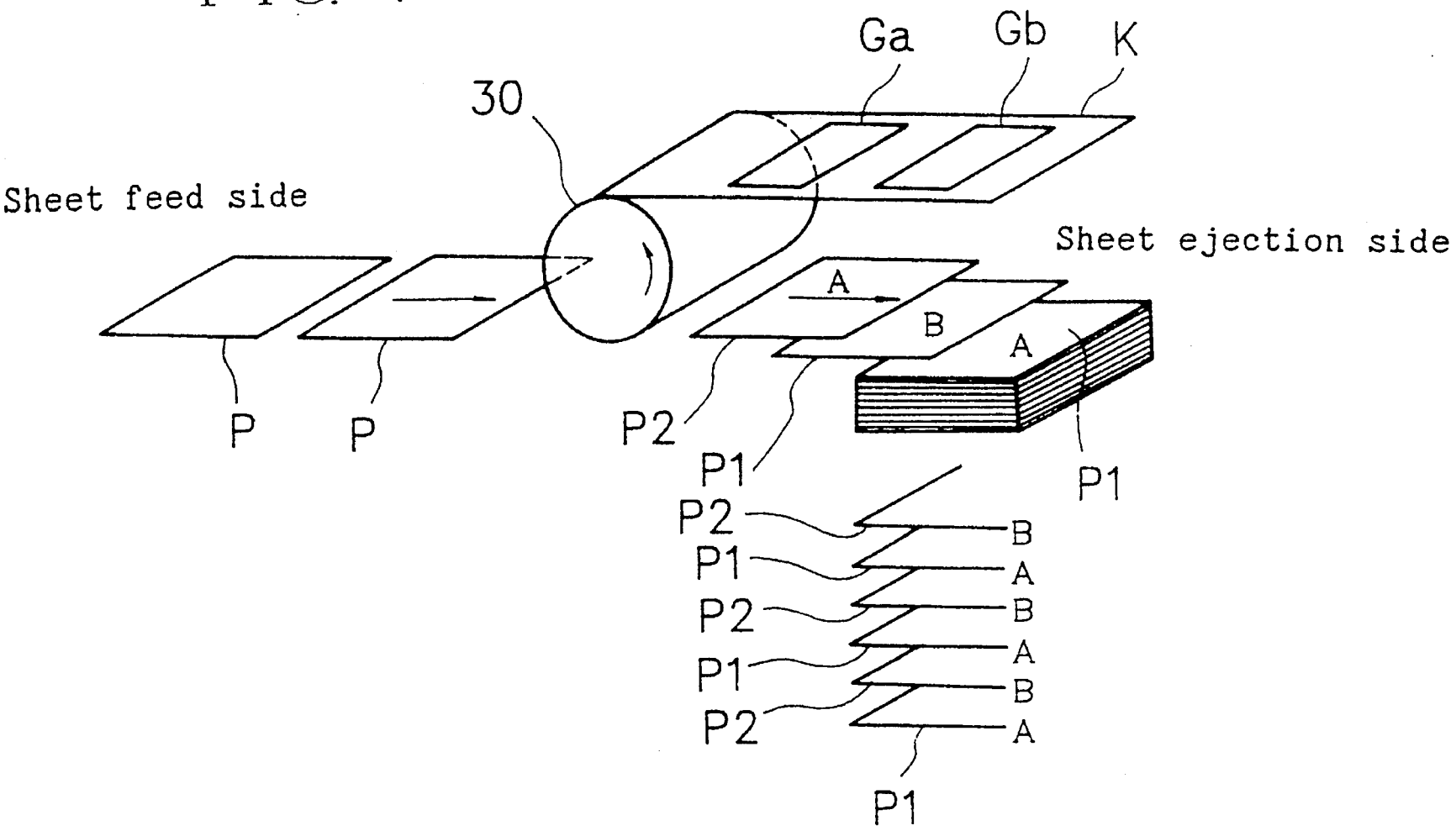
FIG. 7 is a schematic view depicting what typically takes place in N-sheet feed mode of the embodiment.

The N-sheet feed mode of the embodiment will now be described. The setup of FIG. 7 illustrates a two-sheet feed mode, a variation of the N-sheet feed mode. To implement this particular mode, two images Ga and Gb are thermally prepared into two original plates that are arranged at a certain distance apart on an original mimeograph sheet K. The original mimeograph sheet K is then stuck over the drum 30. When two print sheets P are forwarded for secondary feed per revolution of the drum 30, the printing efficiency is approximately doubled.

More specifically, the two-sheet feed mode is implemented as follows: a sheet feed count (2 in this example) is first set on the N-sheet feed setting mean 24. After setting of the sheet count, the N-sheet feed setting means 24 supplies the pulse generating means 25 with a selection signal S3 designating the two-sheet feed.

Figure 8:
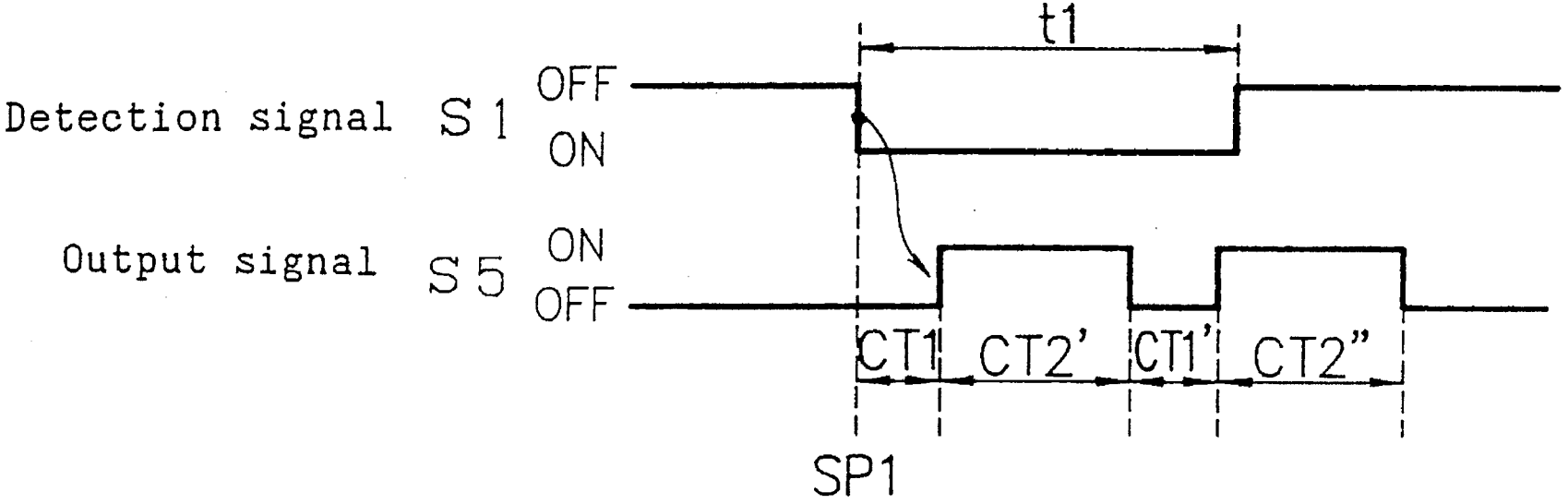
FIG. 8 is a timing chart of control signals used by the control means in N-sheet feed mode.

Given the selection signal S3, the pulse generating means 25 outputs two output signals S5 having output periods CT2' and CT2" derived from a single detection signal S1, as shown in the timing chart of FIG. 8. It should be noted that a delay period CT1' is also interposed between the output periods CT2' and CT2" of the output signals S5. The delay period CT1' corresponds to the distance between the images Ga and Gb on the original mimeograph sheet K. As such, the delay period CT1' is varied depending on the selected printing speed in the manner described.

The distance between the images Ga and Gb on the original mimeograph sheet K is established in advance. The output periods CT1', CT1", CT2' and CT2" of the output signals S5 may be values that are independent of one another.

In the two-sheet feed mode, as depicted in FIG. 7, the secondary sheet feed mechanism 1 feeds two print sheets P1 and P2 consecutively when the drum 30 completes a single turn. This causes the image Ga to be formed on the first print sheet P1 and the image Gb on the second print sheet P2. As the drum 30 continues to rotate, the two images Ga and Gb are printed alternately and consecutively on the print sheets being fed. On the sheet ejection side are stacked a growing number of print sheets P1 and P2 with the images Ga and Gb formed respectively thereon, to be subsequently sorted automatically.

Figure 9:
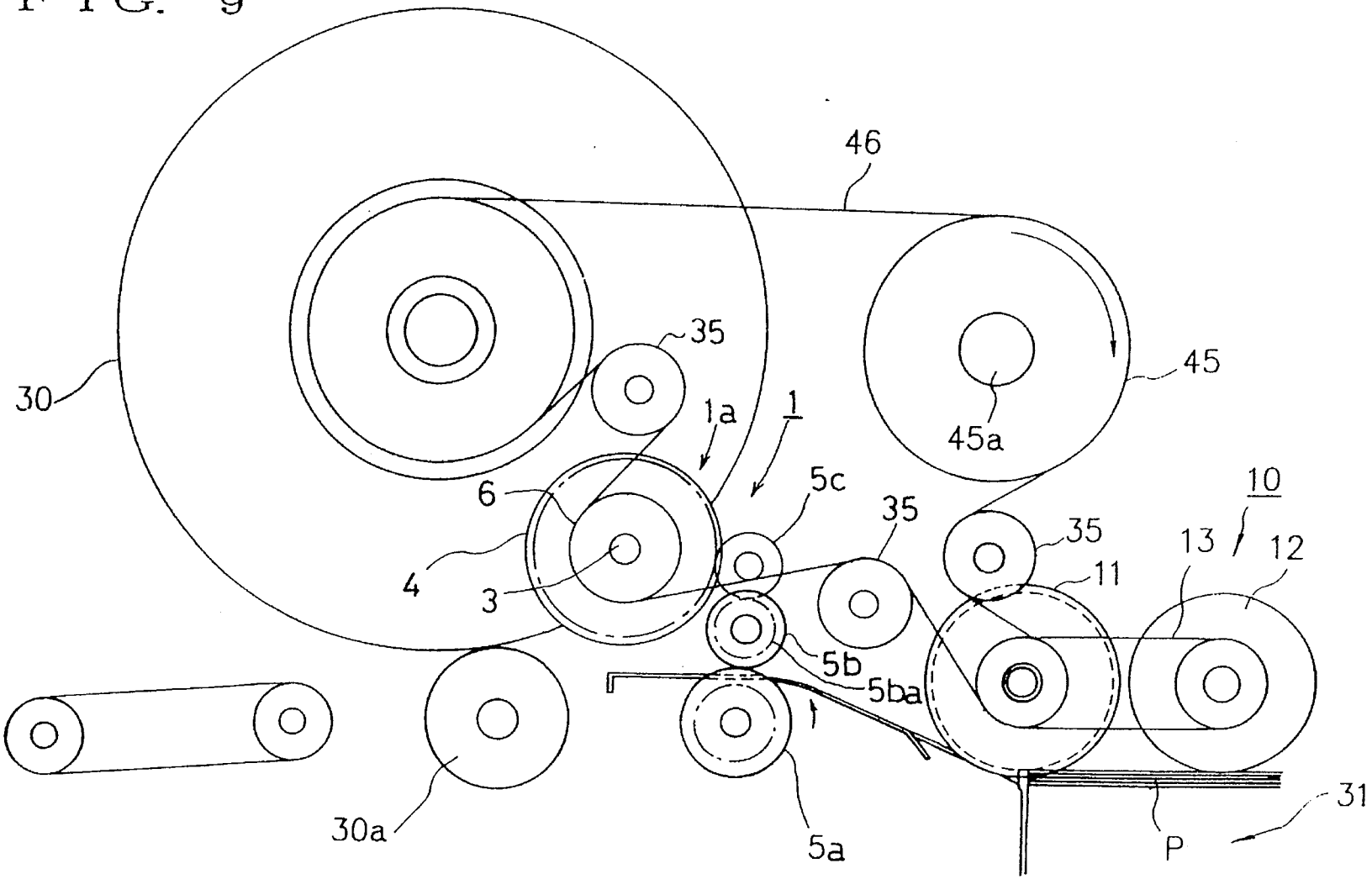
FIG. 9 is a side view of an image forming apparatus practiced as an alternative embodiment of the invention.
Figure 10:
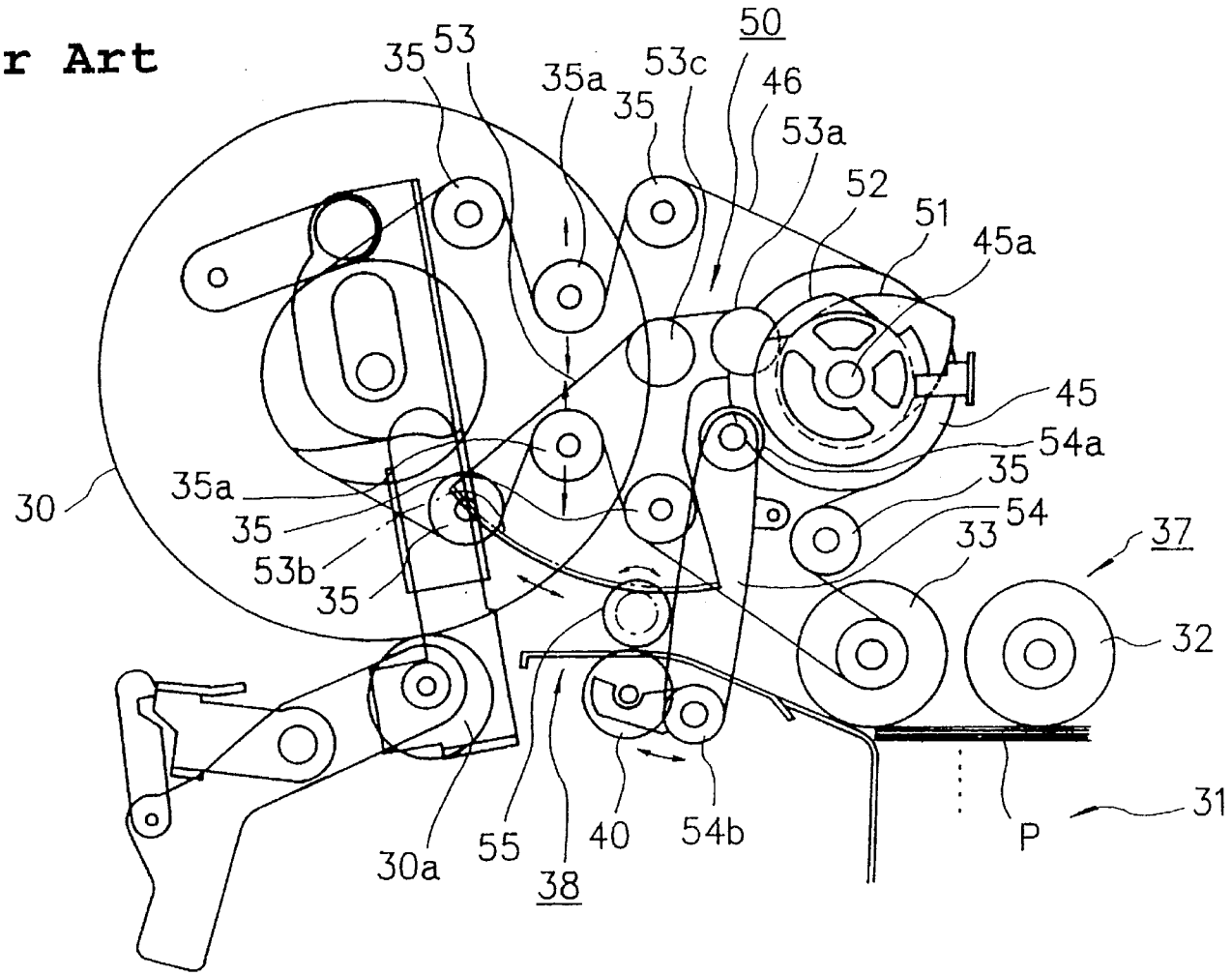
FIG. 10 Prior Art
FIG. 10 is a side view of a conventional image forming apparatus.

FIG. 9 is a side view of an image forming apparatus practiced as an alternative embodiment of the invention. The alternative embodiment includes the electromagnetic clutch la installed on the side of the guide roller 5*b*. In this setup, the electromagnetic clutch 1*a* is engaged with a gear 5*ba* of the guide roller 5*b* via a gear 5*c*. Regardless the installation side of the clutch 1*a*, i.e. on the side of the timing roller 5*a* or of the guide roller 5*b*, the electromagnetic clutch 1*a* provides the same advantageous effects that have been described so far.

For the above-described embodiments, the N-sheet feed mode is implemented illustratively as a two-sheet feed mode involving the two images Ga and Gb. Alternatively, three or more images may be provided on the single original mimeograph sheet K. These images may be either different or identical. In any case, when N-sheet feed mode is established, the number of sheets that may be printed at a given printing speed is increased approximately N-times.

As described and according to one aspect of the invention, the secondary sheet feed mechanism of the inventive image forming apparatus utilizes the electromagnetic clutch whose operation timing is controlled electrically by the control means. This makes it possible for the apparatus of the simple constitution to carry out secondary sheet feed operation to the printing part accurately and unfailingly.

In one preferred structure of the invention, the delay means need only be added so as to deal with a variably set printing speed of the printing part. The simple constitution of the inventive image forming apparatus readily incorporates the addition for the purpose, whereby the printing speed may be varied as desired.

In another preferred structure of the invention, the vertical image forming position relative to the print sheet surface is adjusted easily and precisely with the same simple constitution of the apparatus.

In a further preferred structure of the invention, the number of sheets for secondary feed operation may be increased N-times for a given printing speed of the printing part. This means that the efficiency of printing is increased approximately N-times according to the invention.

What is claimed is:

1. An image forming apparatus for forming desired images continuously onto print sheets, comprising:

a printing part;

a primary sheet feed mechanism for extracting one by one the print sheets stacked on a sheet feed table; and a secondary sheet feed mechanism situated near the primary sheet feed mechanism, said secondary sheet feed mechanism taking each print sheet extracted by said primary sheet feed mechanism and feeding said print sheet toward said printing part at a rate corresponding to the printing speed of said printing part;

said secondary sheet feed mechanism comprising:

a timing roller and a guide roller situated adjacent to each other, said timing roller and guide roller contacting said print sheet for feeding thereof;

an electromagnetic clutch connected to one of said timing roller and said guide roller, said electromagnetic clutch, when actuated, activating the timing roller and guide roller to feed the sheet from the secondary sheet feed mechanism to the printing part; and control means electrically connected to the electromagnetic clutch, said control means having a device for detecting a rotating status of said printing part and supplying said electromagnetic clutch with an output signal in synchronism with said rotating status of said printing part to actuate the timing roller and the guide roller so that the sheet is fed to the printing part according to the rotating status while adjusting a sheet feed timing based on the rotating status.

2. An image forming apparatus according to claim 1, wherein said printing part has a switch for changing a printing speed, and said control means further includes delay means for outputting the output signal after a delay period corresponding to a currently selected printing speed, said delay period being shortened as the printing speed increases so that an operation timing of said electromagnetic clutch varies in keeping with said currently selected printing speed of said printing part.

3. An image forming apparatus according to claim 2, wherein said control means includes vertical position setting means for setting a vertical position of the print sheets beforehand and for outputting a vertical position signal corresponding to the vertical position, and wherein said delay means modifies the operation timing of said electromagnetic clutch by varying said delay period in accordance with said vertical position signal so that the vertical position of the image to be printed is changed as desired relative to a print sheet surface.

4. An image forming apparatus according to claim 1, wherein said control means further comprises:

N-sheet feed setting means for having a variable number N of print sheets established therein for printing during each revolution of said printing part, and for outputting a selection signal corresponding to the established number N of print sheets; and pulse generating means for receiving said selection signal from said N-sheet feed setting means and for outputting a plurality of pulse signals representing N print sheets derived from said selection signal, said electromagnetic clutch being activated N times during one operation of said printing part to which said N print sheets are fed.

* * * * *